United States Patent [19]

Miyazaki et al.

[11] Patent Number: 4,588,063

[45] Date of Patent: May 13, 1986

[54] SUPPLY CHUTE FOR SUPPLYING EMPTY BOBBINS TO A SPINNING FRAME

[75] Inventors: Tsutomu Miyazaki, Kariya; Tatemi Fukuda, Chita; Kazuya Yoshimine, Kariya, all of Japan

[73] Assignee: Kabushiki Kaisha Toyoda Jidoshokki Seisakusho, Kariya, Japan

[21] Appl. No.: 574,841

[22] Filed: Jan. 27, 1984

[30] Foreign Application Priority Data

Jul. 15, 1983 [JP] Japan ..... 58-129099

[51] Int. Cl.[4] ..... B65G 11/08

[52] U.S. Cl. ..... 193/27; 57/274

[58] Field of Search ..... 193/27, 28; 198/560, 198/562, 534; 221/281; 57/270, 274, 276

[56] References Cited

U.S. PATENT DOCUMENTS 1,457,177 5/1923 Lee ..... 193/27 X
2,408,380 10/1946 Dennis ..... 193/27 X
4,181,228 1/1980 Hashimoto et al. .

FOREIGN PATENT DOCUMENTS 1477855 12/1969 Fed. Rep. of Germany ..... 193/27
76530 5/1983 Japan .

*Primary Examiner*—Jeffrey V. Nase
*Attorney, Agent, or Firm*—Brooks Haidt Haffner & Delahunty

[57] ABSTRACT

The supply chute of the present invention operates to supply empty bobbins to a bobbin reserve unit provided above a conveyor for transporting empty bobbins to a spinning frame, while maintaining the empty bobbins in substantially horizontal position as they fall down the chute. The chute presents a zigzag-shaped route in the direction of movement of the empty bobbins, which route is comprised of a plurality of subtantially vertically extending sections each having a length smaller than the length of the empty bobbin, each section being offset laterally with respect to the adjoining section or sections.

3 Claims, 4 Drawing Figures

SUPPLY CHUTE FOR SUPPLYING EMPTY BOBBINS TO A SPINNING FRAME

BACKGROUND OF THE INVENTION

This invention relates to a chute for supplying empty bobbins to a spinning frame. More particularly, it relates to such chute for promptly transporting empty bobbins to a reserve unit mounted above an empty bobbin supply conveyor of the spinning frame, said empty bobbins being maintained in substantially horizontally position during transport and not being caused to dwell for any appreciable time period in the chute.

According to conventional practice, the spinning frame and the winder integrated therewith are not coordinated but are operated independently of one another. Therefore, a number of empty bobbins, that is, the bobbins from which the yarn has been unwound in the winder, are placed in a single salvage casing, and transported therein to a reserve box of the spinning frame where they are pooled or stored. These empty bobbins are then supplied from the reserve box one by one to an empty bobbin supply conveyor and thereby transported to an automatic doffer where they are replaced by full packaged bobbins.

In an effort to increase manufacturing efficiency not only of the spinning process but of the winding and related processes, it has become customary in recent times to interconnect the spinning frame and the winder by means of a pair of conveyors so that full packaged bobbins prepared in the spinning frame are transported directly to the winder and the bobbins from which the yarn has been unwound at the winder are returned to the spinning frame.

In such case, it becomes necessary that these empty bobbins are returned one by one from the winder by a belt conveyor and supplied thereby to the chute in substantially horizontal position without becoming stagnant in the chute so as to be stored in a reserve device mounted above the empty bobbin supply conveyor of the spinning frame.

In the conventional system, as discussed above, all of the bobbins are stored in the reserve box and pushed out of the box by the bobbins that follow closely one after the other. Hence, the bobbins are shifted on very rare occasions from their horizontal to their vertical positions during transport thereof. However, in the new system, the empty bobbins supplied in horizontal position to the upper part of the chute are most likely to be shifted from their horizontal to their vertical position during intermittent transport through the chute. In such case, the chute may be stopped up with empty bobbins and thus unable to carry out smooth transport of the bobbins. In addition, difficulties are presented in disposing of the empty bobbins in the ensuing steps in case the bobbins are transported in this manner in the upright position. This problem is most acute when the bobbin is tapered because then it is likely to descend with its large end downward.

SUMMARY OF THE INVENTION

In view of the aforementioned problem of the prior art, it is a principal object of the present invention to provide a supply chute whereby the empty bobbins supplied is substantially horizontal position are not caused to dwell for any appreciable period of time in the chute but are transported promptly to the reserve unit provided on the upper part of the empty bobbin supply conveyor connected to the spinning frame, in such a manner that the bobbins are unable to stop up the chute and are maintained in horizontal position during transport thereof through the chute.

In view of this object, the present invention provides a chute for supplying empty bobbins to a spinning frame, in which empty bobbins are supplied in substantially horizontal position to reserve unit disposed above an empty bobbin supply conveyor of a spinning frame, said chute presenting a zigzag-shaped route extending in the direction of movement of the empty bobbins, said zigzag-shaped route consisting of a series of juxtaposed substantially vertically extending sections each being shorter in length than the empty bobbin and being laterally offset from the adjoining one or ones of said vertical sections. Preferably, the lateral offset of the chute is larger than the diameter of the empty bobbin. However, in this case, the length of the vertical section is preferably larger than the offset.

According to a characteristic feature of the present invention, for realizing prompt transport of the empty bobbins, the chute presents a zigzag-shaped route consisting essentially of a plurality of juxtaposed vertically extending sections. In certain types of storage chutes, zigzag-shaped routes are conventionally provided for enhancing the storage capacity of the chute. However, these zigzag-shaped routes are intended for an object different from that of the present invention and are not provided with definitely vertically extending sections such as are employed in the present invention.

BRIEF DESCRIPTION OF THE DRAWINGS

The invention will become more readily apparent from the following description of a preferred embodiment thereof shown, by way of example only, in the accompanying drawings, in which.

DESCRIPTION OF THE PREFERRED EMBODIMENT

A supply chute for supplying empty bobbins to a spinning frame embodying the present invention is now described by referring to the accompanying drawings.

Figure 1:
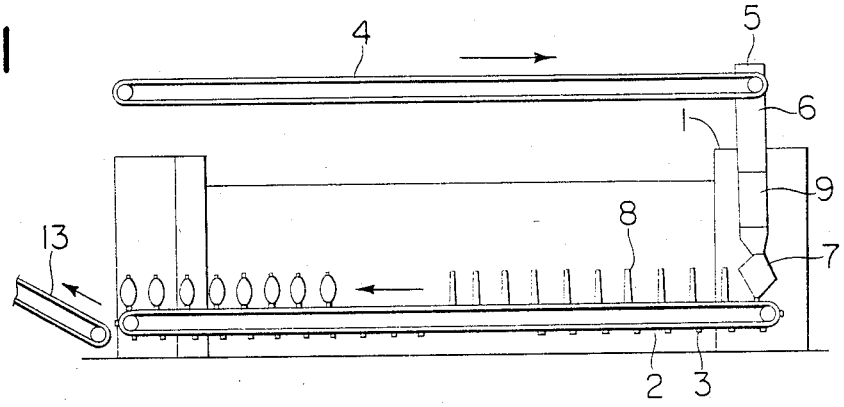
FIG. 1 is a front view of a spinning frame embodying the teaching of the present invention.
Figure 3:
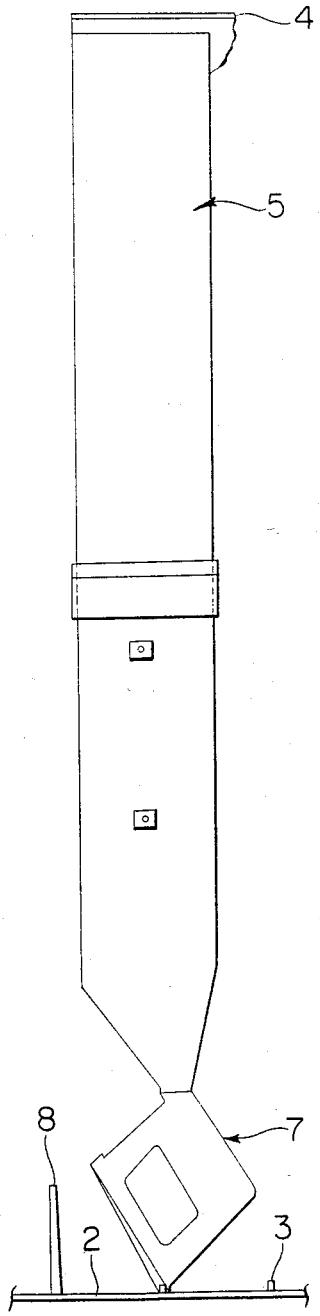
FIG. 3 is a side view showing the chute shown in FIG. 2.

Referring to FIG. 1, a conveyor 2 for transporting empty bobbins is mounted at the lower front side of and alongside a spinning frame 1 and adapted for supplying empty bobbins 8 to the spinning frame 1. The conveyor 2 is operatively associated with a conveyor 13 adapted for supplying full yarn bobbins to an adjoining winder, not shown, in such a condition that empty bobbins 8 are replaced by an automatic doffer, not shown, with full packaged bobbins formed in the spinning frame 1, and the full packaged bobbins thus formed are transferred to the winder by conveyors 2, 13.

The empty bobbins 8, that is, the bobbins from which the yarn has been unwound at the winder, are returned by an empty bobbin return conveyor 4 one by one to the upper part of the spinning frame 1 and supplied substantially horizontally to a chute 5 of the present invention. The chute 5 is passed through a space between the roving yarns to be set on the creel of the spinning frame 1 and connected through a pool section 9 to a reserve unit 7. The pool section 9 is adapted to store in a closely packed state the empty bobbins 8 supplied one after another from return conveyor 4 to chute 5. The operation of empty bobbin supply conveyor 2 and empty bobbin return conveyor 4 is controlled by a photoelectric upper limit sensor 10 and a photoelectric lower limit sensor 11 in such manner that the upper limit of the stored empty bobbins 8 is situated at all times between said upper and lower limit sensors. The reserve unit 7 is of any suitable construction and adapted to supply the empty bobbins 8 one by one to the empty bobbin supply conveyor 2 by engaging the lower ends of bobbins 8 one by one with pegs 3 of the supply conveyor 2.

Figure 2:
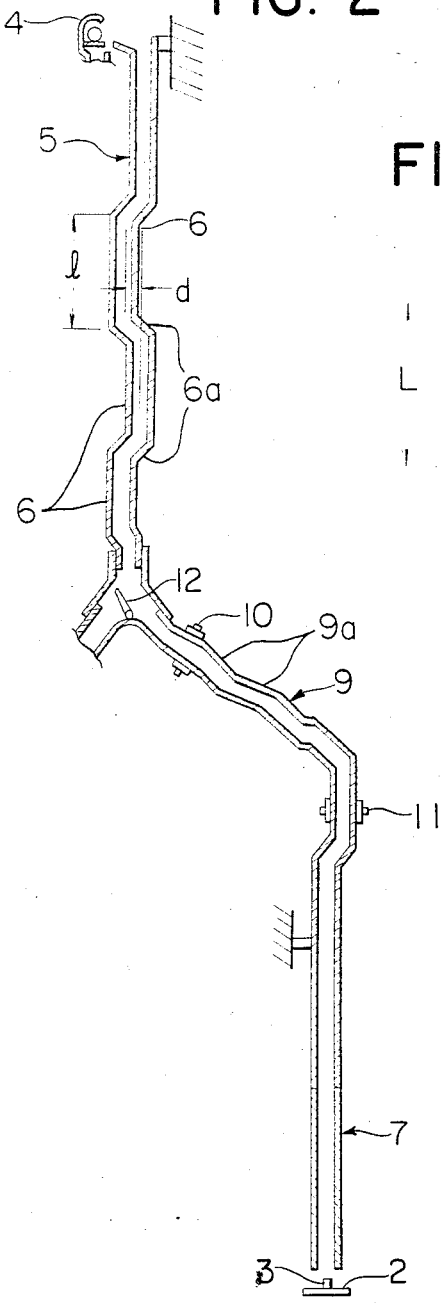
FIG. 2 is an enlarged sectional view showing a chute according to the present invention.

As shown in FIG. 2, chute 5 consists of a plurality of interconnected vertical sections 6 disposed in a zigzag arrangement with repsect to a vertical axis. The length or height l of each vertical section 6 is shorter than the length L of the empty bobbin 8 travelling through the chute 5 (see FIG. 4) and each section 6 is offset by a lateral chute section *6a* a distance d from the adjoining section or sections. Preferably, the distance d should be larger than the large diameter D of the tapered and circular empty bobbin 8, and the length l of each vertical section 6 should be larger than distance d. In this manner, the horizontal offset of the chute 5 may be reduced. The numeral 12 denotes a route switching member whereby empty bobbins 8 may alternately be supplied to left-hand or right-hand side pool sections.

In the operation of the empty bobbin supply chute of the present invention, empty bobbins 8 are supplied horizontally from the empty bobbin return conveyor 4 one by one to the supply chute 5.

During normal operation, the empty bobbins 8 are caused to descend in horizontal position in the chute 5 and are supplied to pool section 9, formed by a number of alternately offset short-length chute sections *9a*, from where they are supplied one by one to the empty bobbin supply conveyor 2 via reserve unit 7.

Figure 4:
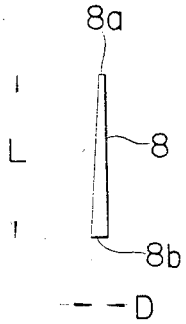
FIG. 4 is a front view of an empty bobbin to be transported through the chute.

In the event that the empty bobbin 8 is a tapered bobbin as shown in FIG. 4, bobbin 8 tends to descend naturally with its large end downwards. However, even when the empty bobbin 8 is about to be tilted in chute 5 from its horizontal position and to gradually assume a vertical position, it is not possible for the empty bobbin 8 to assume a completely vertical position, because the length l of the vertical section 6 of the chute 5 is shorter than the length L of the empty bobbin 8. In addition, any two contiguous vertically extending adjacent sections 6 are displaced from each other substantially horizontally. Therefore, empty bobbins 8 arriving in an inclined position at the connecting zone of the vertically extending sections 6 are inhibited from passing therethrough. That is, it is only when the empty bobbin 8 has arrived in its entirety at said connecting zone, that is, when the empty bobbin 8 has assumed a substantially horizontal position, that the bobbin 8 is allowed to pass through said connecting zone. Therefore, according to the present invention, empty bobbins 8 are supplied at all times in horizontal position.

The chute 5 of the present invention is comprised of vertically extending sections 6, so that empty bobbins 8 are conveyed promptly through sections 6 without stopping up the chute 5. Above all, the length l of vertical section 6 is selected to be larger than the offset distance d thus desirably enabling a high speed transport of empty bobbins 8. The inventive chute 5 is of sufficiently small overall width to be mounted between roving yarns set on creels of the spinning frame.

From the foregoing it is seen that the arrangement of the present invention provides a supply chute of compact size in which the empty bobbins supplied thereto is substantially horizontal position may be kept in this position during their transport therethrough to the reserve unit disposed above the empty bobbin supply conveyor of the spinning frame, and in which the bobbins may be conveyed promptly in this manner without becoming locally stagnant during transport.

What is claimed is:

1. A supply chute for supplying empty bobbins is substantially horizontal position to a bobbin reserve unit disposed above an empty bobbin transport conveyor on a spinning frame, said bobbins having uniform predetermined length and tapered circular configuration providing uniform large and small diameters of each bobbin, said supply chute comprising a sequentially arranged plurality of vertical chute sections each providing a chute opening having dimensions for slidable passage of only one horizontally disposed bobbin at a time therethrough, and a plurality of substantially lateral chute sections each respectively disposed between, and projecting a lateral distance from sequentially adjacent ones of said vertical chute sections, each said lateral chute section having a chute opening whose dimensions are substantially the same as those of the chute opening of each said vertical chute section and having a predetermined length, and the vertical height of each said vertical chute section being shorter than said predetermined length of one of said bobbins and greater than said lateral projecting distance and the length of each said lateral chute section.

2. A supply chute according to claim 1, wherein said lateral projecting distance of each said lateral chute section is larger than said large diameter of each bobbin.

3. A supply chute according to claim 1, which further comprises a storage section of said chute comprising a substantially lateral extending chute path formed by a plurality of sequentially arranged and alternately offset short-length chute sections for receiving and storing said horizontally disposed bobbins from said vertical and lateral chute sections.

* * * * *

UNITED STATES PATENT AND TRADEMARK OFFICE

CERTIFICATE OF CORRECTION

PATENT NO. : 4,588,063

DATED : May 13, 1986

INVENTOR(S) : MIYAZAKI ET AL.

It is certified that error appears in the above-identified patent and that said Letters Patent is hereby corrected as shown below:

In the Abstract, line 8, "subtantially" should be --substantially--.

Column 1, line 11, "horizontally" should be --horizontal--.

Column 1, line 65, "is" should be --in--.

Column 2, line 8, between "to" and "reserve", "a" should be inserted.

Column 3, line 18, "repsect" should be --respect--.

Column 4, line 16, last word "is" should be --in--.

Column 4, line 24, last word "is" should be --in--.

Signed and Sealed this

*Sixteenth* Day of *September 1986*

[SEAL]

*Attest:*

DONALD J. QUIGG

*Attesting Officer*

*Commissioner of Patents and Trademarks*